US006452580B1

(12) United States Patent
Edwards et al.

(10) Patent No.: US 6,452,580 B1
(45) Date of Patent: Sep. 17, 2002

(54) ACTIVE MATRIX LIQUID CRYSTAL DISPLAY DEVICE

(75) Inventors: Martin J. Edwards; Alan G. Knapp, both of Crawley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 207 days.

(21) Appl. No.: 09/606,336

(22) Filed: Jun. 29, 2000

(30) Foreign Application Priority Data

Jul. 2, 1999 (GB) ..... 9915572

(51) Int. Cl.[7] ..... G09G 3/36

(52) U.S. Cl. ..... 345/100; 345/92; 345/208; 345/94

(58) Field of Search ..... 345/87–104, 204, 345/208–210; 349/42, 46

(56) References Cited

U.S. PATENT DOCUMENTS 4,714,921 A * 12/1987 Kanno et al. ..... 340/784
4,890,101 A 12/1989 Carlson ..... 340/811
5,021,774 A * 6/1991 Ohwada et al. ..... 340/811
5,130,829 A 7/1992 Shannon ..... 359/59
5,598,177 A * 1/1997 Mizukata et al. ..... 345/92
5,641,974 A 6/1997 Den Boer et al. ..... 257/59

FOREIGN PATENT DOCUMENTS

EP 0617310 A1 9/1994 ..... G02F/1/1335
EP 0678848 * 10/1995 ..... G09G/3/36
EP 0737957 * 10/1996 ..... G09G/3/36
JP 402082295 A * 3/1990 ..... G09G/3/36

* cited by examiner

*Primary Examiner*—Lun-Yi Lao

(57) ABSTRACT

An active matrix LC display device comprises an array of display elements (10) driven via sets of row and column address conductors (14, 16) connected respectively to a row drive circuit (30) operable to select each row in turn and a column drive circuit (35) for providing respective data signals for the display elements of a selected row and which comprises a multiplexing circuit arranged to address groups of column address conductors (16) in succession during a row address period. To avoid, or reduce, unwanted display artifacts arising from the use of a multiplexing circuit, the column drive circuit (35) is arranged to charge at least the last column address conductor in a group in at least two separate charging periods with the second charging period occurring after a charging period of the next group in the sequence.

6 Claims, 5 Drawing Sheets

ACTIVE MATRIX LIQUID CRYSTAL DISPLAY DEVICE

BACKGROUND OF THE INVENTION

The present invention relates to an active matrix liquid crystal display device comprising a row and column array of liquid crystal display elements, each display element having an associated switching device, sets of row and column address conductors connected to the display elements via which selection signals and data signals respectively are applied to the display elements, a row drive circuit for applying selection signals to the row address conductors in respective row address periods and a column drive circuit for applying data signals to the set of column address conductors, which column drive circuit is operable to apply the data signals for the display elements of a row to groups of column address conductors in sequence in respective group address periods, each group comprising a plurality of column address conductors, with the column address conductors in a group being charged in the respective group address period according to the level of their relevant data signals.

Active matrix liquid crystal (LC) display devices suitable for displaying datagraphic or video information are well known. Typical examples of such, which use TFTs (thin film transistors) as the switching devices that are connected between the display element electrodes and the sets of row and column address conductors, and the general manner in which they operate, are described in U.S. Pat. No. 5,130,829. In these devices, a row drive circuit connected to the set of row address conductors scans the row conductors by applying a selection (gating) signal to each row conductor in sequence to turn on the TFTs of a row of display elements, and a column drive circuit connected to the set of column conductors applies data signals to the column conductors in synchronism with scanning of the row conductors by the row drive circuit whereby the display elements of a selected row are charged via their respective TFTs to a level dependent on the value of the data signal on their associated column conductors to produce a required display output. The rows are driven individually in turn during respective row address periods in this manner so as to build up a display picture over one field period, and the array of display elements is repeatedly addressed in similar manner in successive field periods.

For convenience of manufacture and compactness, the row and/or column drive circuits in some display devices, and especially those using polysilicon TFTs, have been integrated on the substrate carrying the TFTs peripherally of the display element array using the same large area electronics technology as that employed for the active matrix circuitry of the array with the circuitry of the drive circuits being fabricated simultaneously and similarly comprising TFTs, conductor lines, etc. Due to limitations in operational performance of the TFTs and the kinds of circuit possible when using TFTs, the column drive circuit is customarily provided in the form of a simple multiplexing circuit, examples of which are described in U.S. Pat. No. 4,890,101, and the paper entitled "A 1.8-in Poly-Si TFT-LCD for HDTV Projectors with a 5-V Fully Integrated Driver" by S. Higashi et al in SID 95 Digest, pages 81 to 84. The operation of the column drive circuit is based on a multiplexing technique in which analogue video information (data) is sequentially transferred via multiplexing switches from a plurality of video input lines, to which video information is applied simultaneously, to corresponding groups or blocks of column address conductors with each column conductor in a group being connected via a multiplexer switch to a different video input line. Each column address conductor is connected to a respective output of the circuit and typically in these circuits the operation is such that an output associated with one column conductor becomes high impedance prior to, or while, the data signal for an adjacent column conductor is applied. During a row address (video line) period the multiplexer circuit operates to charge each group of column conductors in turn until all the column conductors in the display device have been charged to a level corresponding to the associated level of the video information on the input lines. Once a group of column conductors has been charged the associated multiplexing switches open and the column conductors become high impedance nodes with the voltage applied being maintained on the column conductor capacitance, and then the next group is charged. The circuit operates in this manner so as to charge all the groups in sequence and to drive each row of display elements in turn in this way during respective row address periods.

It has been found that problems can occur in the display output from the display element array when using such a column drive circuit. Particularly, certain columns in the array may show errors by virtue of the display elements in these columns having incorrect drive levels which results, for example, in a lack of display uniformity when displaying uniform grey fields that manifests itself as highly visible vertical lines in the displayed image. The problem is particularly apparent in high aperture type display devices, for example of the kind described in U.S. Pat. No. 5,641,974 and EP-A-0617310, in which portions of the display element electrodes are arranged to overlap partially the two adjacent column address conductors (and row address conductors) so as to increase their effective apertures.

SUMMARY OF THE INVENTION

It is an object of the present invention to provide an active matrix display device of the kind using column drive circuit which operates in the manner of a multiplexing circuit in which the problem of the aforementioned undesirable display output artefacts is overcome or reduced at least to some extent.

According to the present invention there is provided an active matrix liquid crystal display device of the kind described in the opening paragraph which is characterised in that the column drive circuit is arranged to charge in a row address period at least the last column conductor of a group in at least two separate charging periods with the second charging period for the at least last column conductor occurring after the charging period of the next group in the sequence. The extent of the unwanted display artefacts is considerably reduced by multiple charging of the column conductors in this way.

It has been determined that capacitive couplings can occur between adjacent column address conductors, either directly or indirectly, and the presence of such indirect or direct capacitance means that as the voltage on the first column conductor of one group is changed in operation of the column drive circuit, this change in voltage can be coupled onto at least the last column conductor of the previously addressed group (that is, the column conductor adjacent the next addressed group) through such capacitance, thereby disturbing the voltage set on that last column conductor. This results in errors occurring in the voltage on the last column conductor of each group (apart from the last) which errors lead to the aforementioned visible vertical lines in the displayed image. By using more than one charging period for the columns affected, the size of the voltage error occurring on the last column conductor of a group is reduced.

Preferably, the column drive circuit is arranged to charge each column address conductor in at least two separate charging periods with the second charging period for the group occurring after the first charging period of the next group in the sequence. The voltage error caused to the last column conductor of one group as a result of addressing the next group is the most significant. However, voltage errors will also result in other column conductors in the preceding group, although the extent of such errors progressively decreases. While it may be adequate in some cases to arrange for only the last one or two column conductors in a group to be multiply charged, it would be advantageous to arrange for all column conductors to be multiply charged so as to minimise any errors occurring on other column conductors with all columns then being addressed in a similar manner. This may also be convenient when designing the necessary column drive circuitry.

A column conductor need not be fully charged to the level of the video line voltage, i.e. the data signal level, in each charging period and may be only partially charged in the first charge period. Preferably, however, the column conductor is charged at least close to the required level in the first charge period.

In a preferred embodiment, the charging periods for two successive groups are interleaved in time. Thus, for example, in the case of there being two charging periods for each group, the second charging period for a first group occurs after the first charging period for the second group and before the second charging period for that second group, the first and second charging periods for the third group occur respectively before and after the second charging period for the second group, and so on. Alternatively, the column drive circuit could be arranged to order the charging periods differently. For example, all groups may be addressed in succession, constituting one charging period each, and then the operation repeated to provide the second charging periods, still within the same row address period, so that all groups and column conductors again have two charging periods but this time the first charging periods all occur before the second charging periods. This approach would require the use of a linestore.

BRIEF DESCRIPTION OF THE DRAWING

Embodiments of active matrix display devices in accordance with the present invention will now be described, by way of example, with reference to the accompanying drawings, in which.

It will be appreciated that the Figures are not drawn to scale and that certain dimensions may have been exaggerated whilst other dimensions may have been reduced. The same reference numerals are used throughout the Figures to denote the same or similar parts.

DESCRIPTION OF THE PREFERRED EMBODIMENT

Figure 1:
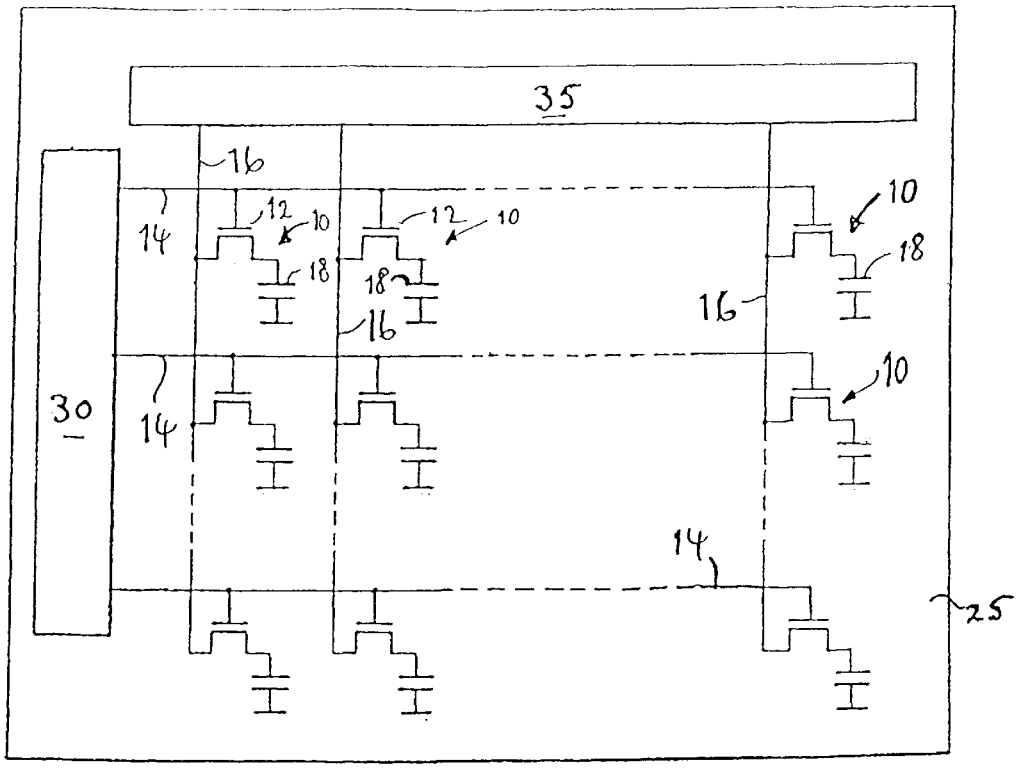
FIG. 1 is a simplified schematic circuit diagram of an active matrix LC display device.

Referring to FIG. 1, the active matrix liquid crystal display device comprises a row and column array of liquid crystal display elements 10. Only a few are shown here for simplicity but in practice there can be several hundred rows and columns of display elements. The display elements each have an associated TFT 12 acting as a switching device, and are addressed by row and column drive circuits 30 and 35 via sets of row and column address conductors 14 and 16. The drain of a TFT 12 is connected to a respective display element electrode 18 situated adjacent the intersection of respective row and column address conductors, while the gates of all the TFTs associated with a respective row of display elements 10 are connected to the same row address conductor 14 and the sources of all the TFTs associated with a respective column of display elements are connected to the same column address conductor 16. The sets of row and column address conductors 14, 16, the TFTs 12, and the picture element electrodes 18 are all carried on the same insulating substrate, for example of glass, and fabricated using known thin film technology involving the deposition and photolithographic patterning of various conductive, insulating and semiconductive layers. A second glass substrate, (not shown) carrying a continuous transparent electrode common to all display elements in the array is arranged spaced from the substrate 25 and the two substrates are sealed together around the periphery of the display element array and separated by spacers to define an enclosed space in which liquid crystal material is contained. Each display element electrode 18 together with an overlying portion of the common electrode and the liquid crystal material therebetween defines a light-modulating display element.

Both the general structure and operation of this device follow conventional practice, for example as described in U.S. Pat. No. 5,130,829. Scanning (gating) signals are applied to each row address conductor 14 in turn by the row drive circuit 30, comprising for example a digital shift register, and data signals, comprising analogue voltage signals, are applied to the column conductors 16, in synchronisation with the gating signals, by the column drive circuit 35. Upon each row conductor being supplied with a gating signal, the TFTs 12 connected to that row conductor are turned on causing the respective display elements to be charged according to the level of the data signal then existing on their associated column conductors. Upon termination of the gating signal at the end of the respective row address period, corresponding for example to the line period of an applied video signal, the associated TFTs are turned off for the remainder of the field period in order to isolate electrically the display elements and ensure the applied charge is stored on the LC capacitance to maintain their display outputs until they are addressed again in a subsequent field period.

In a transmissive operation mode, the electrodes 18 are formed of transparent conductive material and the individual display elements serve to modulate light directed onto one side of the device, e.g. the substrate 25, from a backlight, according to their applied data signal voltage so that a display image can be viewed from the other side. For a reflective mode of operation, the display element electrodes 18 are formed of light reflecting conductive material and light entering the front of the device through the second substrate is modulated by the LC material at each display element and, depending on their display state, reflected by the display element electrodes back through that substrate to generate a display image visible to a viewer at the front of the device.

Figure 2:
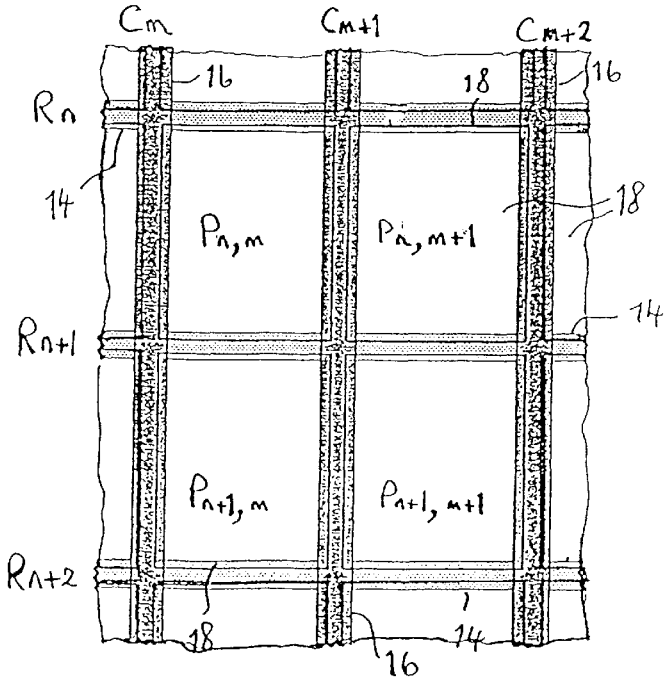
FIG. 2 illustrates schematically the lay-out of the display element electrodes and row and column address conductors in a typical part of a known active matrix LC display device of the high aperture kind.

An example of a typical physical arrangement of the display element electrodes and row and column address conductors in a portion of the array in a high aperture type display is depicted schematically in FIG. 2. The TFTs 12 are omitted here for the sake of clarity, but are located adjacent the intersection of the row and column conductors associated with the display element concerned. The individual display element electrodes 18 are labelled Pn,m where n and m denote their respective row and column numbers. Thus, the electrode Pn,m is addressed via associated row and column conductors Rn and Cm, the electrode Pn,m+1 is addressed via the row and column conductors Rn and Cm+1, the electrode Pn+1,m is addressed via the row and column conductors Rn+1 and Cm, etc. To provide a high aperture, the display element electrodes 18 are carried on an interlayer of insulating material, for example of silicon nitride or an organic material such as polyimide or resist, that is disposed over the active matrix circuitry, comprising the sets of address conductors and the TFTs carried on the substrate, and are extended so as to partly overlap at their opposing vertical side edges the adjacent column conductors 16 and at their top and bottom side edges the adjacent row conductors 14, as shown in FIG. 2. As will be apparent, therefore, each column conductor is overlapped by portions of the display element electrodes in two adjacent columns of display elements. Each display element electrode 18 is connected to the drain of its associated TFT underlying the insulating interlayer through a contact opening (not shown) formed in the layer. The individual display element electrodes 18 are separated from their neighbours by a small gap lying over the row and column conductors. Examples of this type of structure are described in U.S. Pat. No. 5,641,974 and EP-A-0617310 to which reference is invited for a more detailed description.

The row and column drive circuits 30 and 35 are integrated on the substrate 25 and fabricated simultaneously with the active matrix array using the same thin film processing technology. Normally polysilicon technology is used, as in the examples described in the aforementioned papers, although amorphous silicon technology can be employed instead in certain cases. The integrated column drive circuit 35 comprises a simple multiplexing type of circuit. The general operation of such a circuit is based on a multiplexing technique in which analogue video information is sequentially transferred from a plurality of video input lines to corresponding groups of successive column address conductors in the display device. The video information is transferred via multiplexing switches which may consist of NMOS TFTs, PMOS TFTs or CMOS transmission gates. The switches, which each constitute an output of the circuit associated with a respective column conductor, are operated in groups and when a group of switches is turned on the corresponding columns are charged according to the data signal voltage levels then existing on the respective associated video lines. When the switches turn off the voltages on the column conductors are stored on the capacitance of the column conductors and any additional storage capacitors which may be connected in parallel with them. During a respective row address, (videoline), period each group of multiplexing switches is turned on in sequence until all of the columns of display elements have been charged with the appropriate video information.

Figure 3:
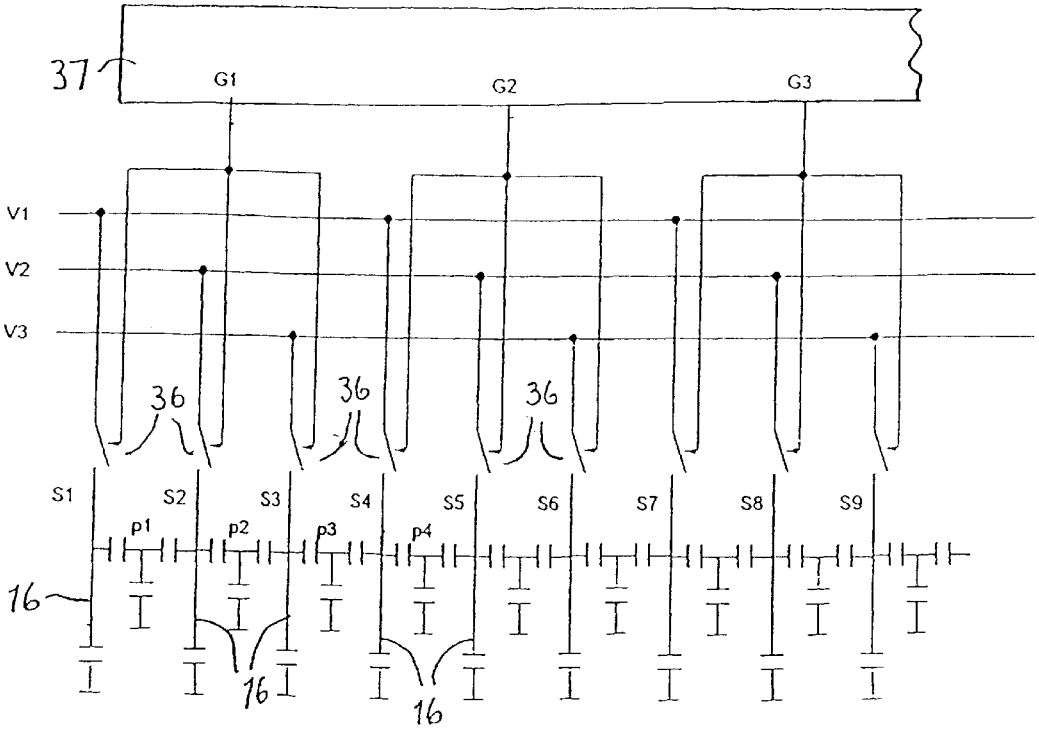
FIG. 3 illustrates schematically a part of a known multiplexing type column drive circuit, together with some column conductors and their associated capacitances.

FIG. 3 illustrates in simplified, schematic, form a part of a known form of multiplexing column drive circuit. In this relatively simple example, there are three video input lines, V1, V2 and V3, to which parallel input video signals are applied, and the multiplexing switches, 36, are arranged in groups of three with their outputs connected to respective consecutive column address conductors 16. A control circuit 37, comprising a shift register which may or may not be integrated on the substrate 25 with the multiplexing circuit, sequentially selects each of the groups of multiplexing switches using the control signals G1, G2, G3, etc so that at the end of the row address period all of the columns in the array have been charged. When G1 goes high the first three multiplexer switches 36 close and the first three columns S1, S2 and S3 are charged to the voltage level then existing on the video lines V1, V2 and V3 respectively. G1 then goes low, opening the three associated multiplexer switches to isolate the columns S1, S2 and S3 from the video lines. The applied voltages are then stored on the column capacitances. Next, the control signal G2 goes high, closing the next group of switches 36, and the second group of three columns, S4, S5 and S6, is charged to the voltages then existing on the respective video lines. The operation of the multiplexing circuit continues in this way with each group of columns being charged appropriately in succession until all the column conductors in the array have been charged in a respective row address period. Subsequent rows of display elements are addressed in similar manner in respective row address periods.

When using such a multiplexing type column drive circuit, problems have been experienced with display artefacts occurring in the form of visible vertical lines at regular intervals over the display area. It has been determined that these artefacts are caused by voltages being unintentionally capacitively coupled onto particular column conductors in operation of the column drive circuit which result in an error in the voltages of the display elements associated with those column conductors, and hence their output brightness. Such capacitive couplings arise mainly due to the fact that the column address conductors 16 extend adjacent to columns of display element electrodes 18. As a consequence, significant capacitance exists between a column address conductor and the adjacent display element electrodes, particularly in the case of a high aperture type of display element lay-out in which the display element electrodes partially overlie the column conductors. Because each column conductor extends between an adjacent pair of display element electrodes in a row, capacitance coupling exists between an adjacent pair of column address conductors indirectly via the electrode. Direct capacitive coupling between two column conductors can occur in an alternative lay-out in which pairs of column conductors are provided adjacent one another and columns of display element electrodes are provided to either side of the pair, one column being addressed via one of column conductors and the other addressed via the second column conductor.

Figure 4:
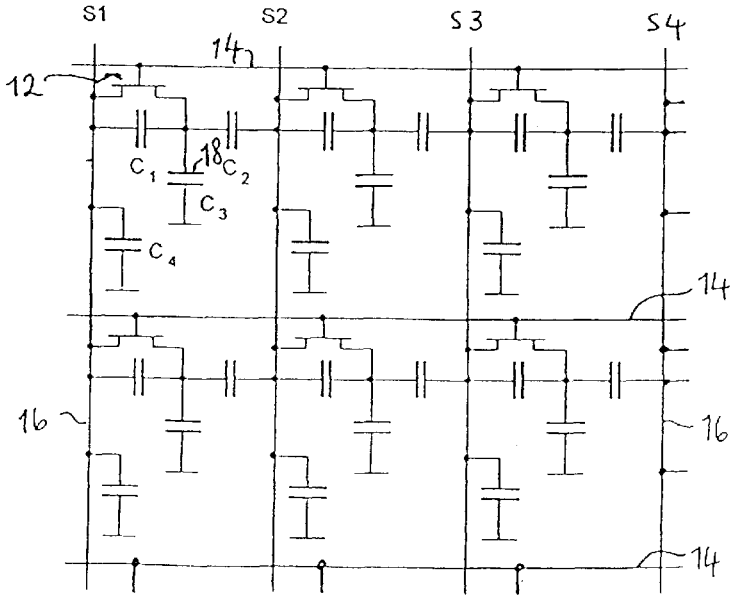
FIG. 4 shows the equivalent circuit of a part of the display element array of the display device of FIG. 1.
Figure 5:
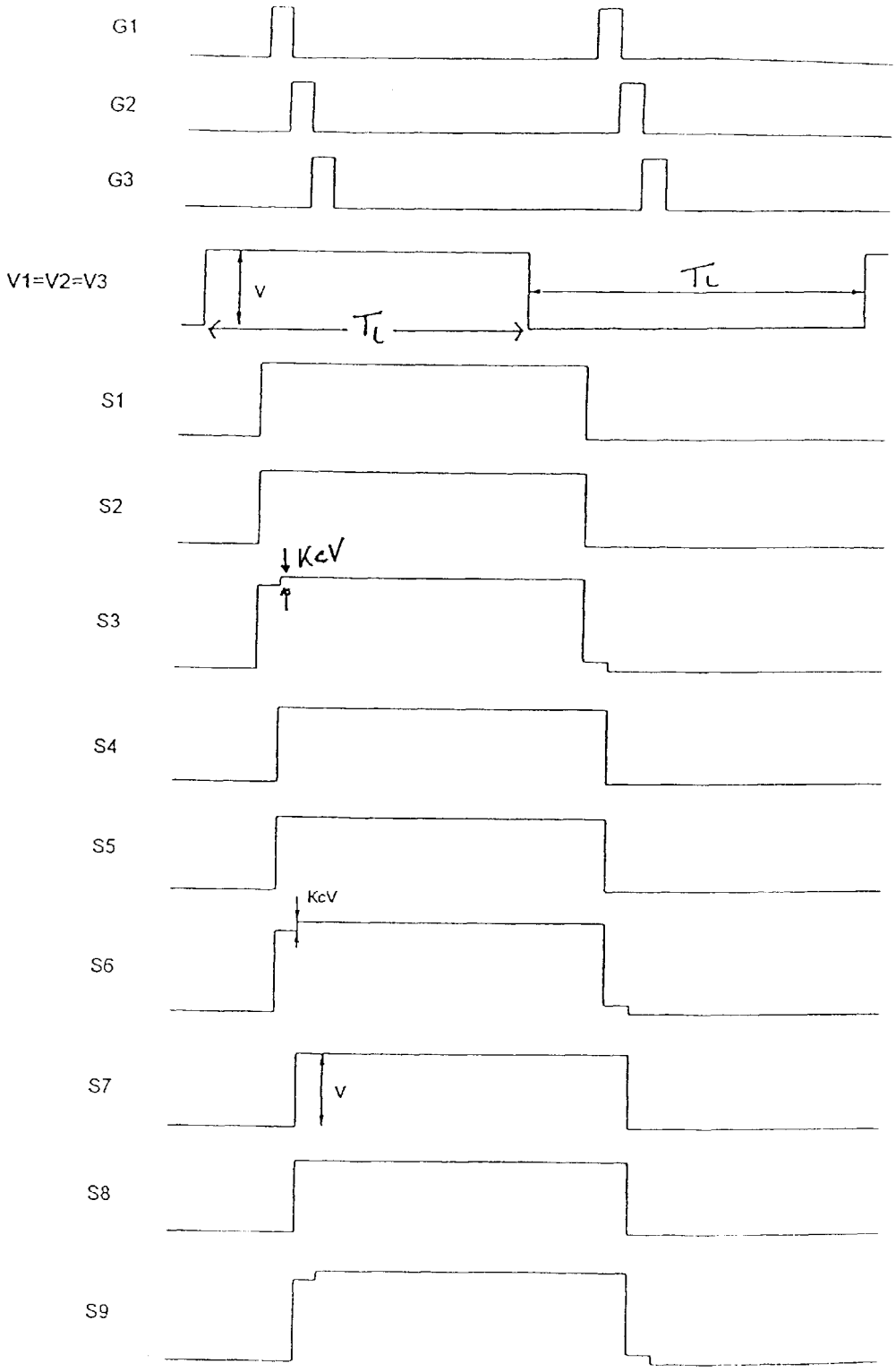
FIG. 5 illustrates typical drive waveforms present in a known manner of operating the display device.

This effect will be described with reference also to FIG. 4, which shows an approximate equivalent circuit for a typical small number of adjacent display elements in the array, and to FIG. 5, which illustrates examples of certain voltage waveforms in operation of the circuit of FIG. 3. The display elements of the display device each contain a number of capacitances, some of which are shown in FIG. 4. $C_1$ and $C_2$ represent the capacitance between a display element electrode 18 and the two adjacent column conductors 16. $C_3$ represents the display element capacitance, which may be a combination of the liquid crystal capacitance and a display element storage capacitor. $C_4$ represents the capacitance of the column conductor and will include the capacitance between the column conductor and the row conductor, the capacitance between the column conductor and the common electrode of the display array and the gate—source capacitances of the TFTs. Other capacitances may also be present and may contribute to the effects described here but have been omitted for clarity.

Considering the effect of a change in the video information on, for example, column conductor S2, for driving a display element in the second column, then this change in voltage is coupled onto the display element capacitance $C_3$ of the preceding display element in the first column via capacitance $C_2$ and therefore causes a change in the display element voltage. If the voltage on column conductor S1 is not being maintained by the column drive circuit, i.e. the relevant column drive circuit output is high impedance and column conductor S1 is floating, then this change in display element voltage can be further coupled onto the column conductor S1 via the capacitor $C_1$. This coupling of a change in voltage on one column conductor onto an adjacent column conductor can be denoted by a coupling factor Kc. If the voltage on one column conductor changes by an amount $\Delta V$, then the change in voltage that this produces on the other column conductor is given by $Kc\Delta V$. This effect will be further explained with reference also to FIGS. 3 and 5. It is assumed here for simplicity that the display array is being addressed with a uniform grey field, and that row inversion, as well as field inversion, of the polarity of the video information drive voltage is used. Similar effects will occur for other inversion methods, for circuits with different numbers of video lines and when the displayed video information is more complex. In FIG. 5, G1, G2 and G3 are the control waveforms applied to the first three groups of multiplexer switches 36 which include voltage pulse signals for turning on these switches, and S1 to S9 are the voltage waveforms appearing on the first nine column conductors. As the display is showing a uniform grey field, the voltage waveforms applied to the three video lines, V1 to V3, are the same, as shown in FIG. 5. The polarity of the video signals inverts after each video line period (TI). The control circuit 37 sequentially selects each of the groups using the control signals G1, G2, G3, etc as previously described so that at the end of the row address (video line) period TI all of the columns in the display have been charged. When G1 goes high the first group of three column conductors, S1, S2 and S3, is charged to the voltage level on the respective video lines. When the second group is selected immediately thereafter by G2 going high, then as the voltage on column conductor S4 changes this change is coupled, with reduced amplitude, onto the display element electrodes of the display elements in the third column, represented by the node p3 in FIG. 3. The change in display element voltage is further coupled onto the last column conductor, S3, in the previously addressed group since this conductor is now isolated from its video line and this results in an error in the column voltage as indicated in the voltage waveform for S3 in FIG. 5. The voltage change is also coupled further to column conductor S2 via the display element node p2 and then to column conductor S1 via node p1. However, at each stage of coupling the magnitude of the coupled signal is reduced by the factor Kc. It is therefore the error in the voltage on S3 which is of the most importance to the uniformity of the displayed image.

Once the second group of three columns has been charged the signal G2 goes low and the second set of multiplexer switches turns off. When the third group of columns is charged by G3 going high, coupling of the change in voltage on column conductor S7 similarly causes an error in the voltage on column conductor S6. This effect occurs in a similar way for each group of columns in the array so that in general the last, or end, column in each multiplexer group will be subject to a significant voltage error due to the voltage change on the adjacent column conductor in the next group, i.e. the first column conductor in the subsequently selected group. This error, which is a kind of cross-talk, manifests itself in the form of vertical lines being visible in the displayed image, the pitch of the lines corresponding to the width of the multiplexer groups.

In order to reduce the magnitude of this error, and hence the visibility of the resulting artefacts in displayed images, the required charging of at least some of the column conductors is accomplished in more than one charging operation.

Figure 6:
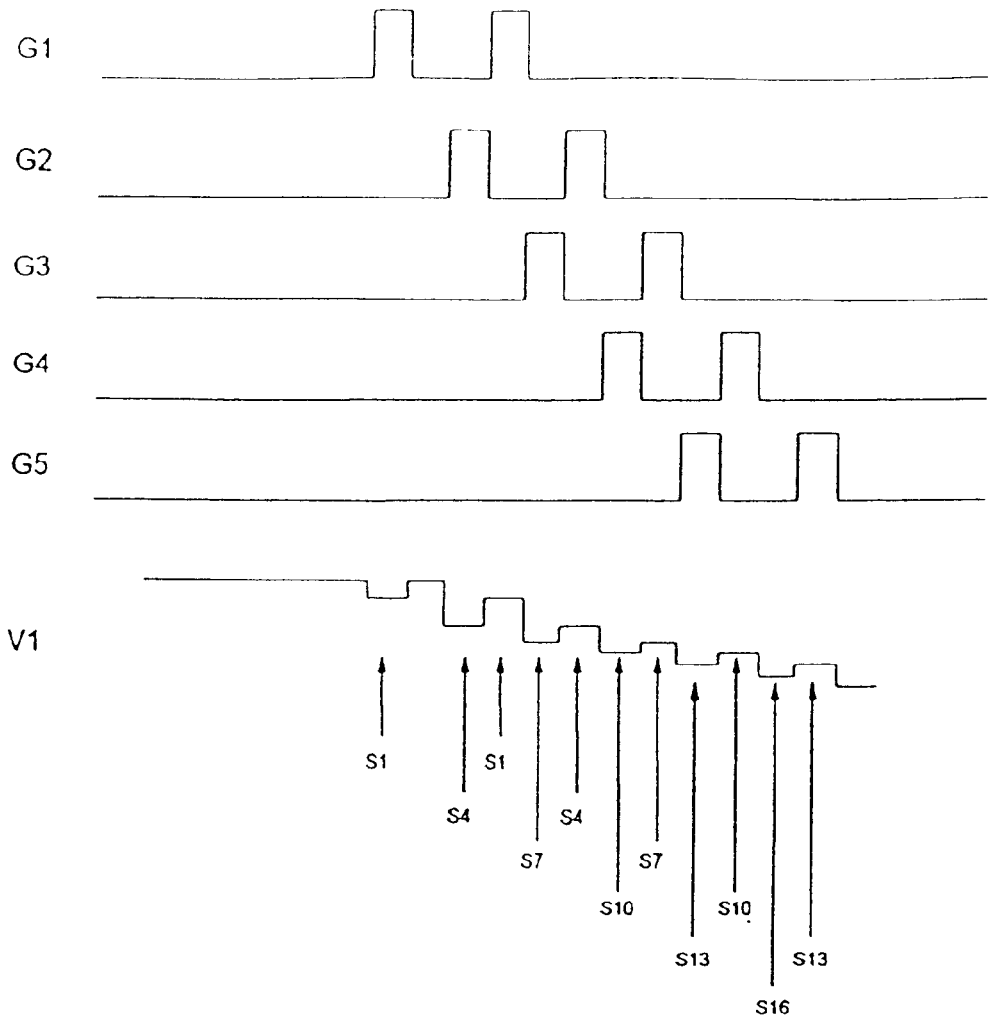
FIGS. 6 and 7 illustrate schematically example waveforms, including control signal waveforms used in the column drive circuit, in operation of an embodiment of display device according to the present invention.

An example of the operation of the column drive circuit using this scheme, in which each column conductor is charged in a plurality of charging operations, is illustrated in FIG. 6 which shows the waveforms for the first five control signals G1 to G5 together with an example modified waveform for the video signal on video line VI comprising data signals of differing levels in this example, for supplying column conductors S1, S4, S7, S10 etc. Whereas in the conventional operation of a multiplexing column drive circuit as described above the groups of column conductors are charged in a single sequence, the column conductors in this scheme are charged by using two, or more, separate charging periods within each row address period. Such operation is achieved by appropriate modification of the control circuit 37 supplying the control signal waveforms. In the example scheme depicted in FIG. 6, two charging periods for each group are involved and the charging periods for successive groups of column conductors are interleaved. Thus, each of the control signal waveforms G1, G2 etc comprises two pulse signals of substantially identical duration separated in time which both operate their respective associated group of multiplexing switches 36, and define first and second charge periods respectively. As shown in FIG. 6, the pulse signals of the control signals G1, G2, G3 etc are organised in sequence such that the first pulse signal defining the first charge period of one group occurs in the interval between the first and second pulse signals for the preceding group and such that the pulse signals in all the control waveforms each occupy a respective and different time slot and do not coincide or overlap with one another. Thus, for example, while the second pulse signal of G1 and the first pulse signal of G3 both occur in the interval between the first and second pulse signals of G2, they occupy respectively former and latter parts of that interval. If the total number of group of columns in the array is C then the duration of each of the control signals can be approximately TI/2C.

In operation, video information (data signals) intended for the first group of columns, S1, S2 and S3 in FIG. 3, is applied to the video lines and the first group of multiplexer switches 36 is selected by the first pulse signal of G1. Upon termination of this pulse signal the switches 36 of the first group open and then video information for the second group of columns, S4, S5 and S6, is applied to the video lines and the second group of multiplexer switches 36 is selected by the first pulse signal of the control signal G2. Following the termination of this, and the opening of these switches, the video information for the first group is again applied to the video lines and the first group of multiplexer switches then selected, by the second pulse signal of G1, for a second time so as to charge the first group of columns according to their applied video information again. This is followed immediately by the video information for the third group of columns, S7, S8 and S9, being applied to the video lines and selection of the third group of multiplexer switches, by the first pulse signal of G3, and then the video information for the second group is applied once again and the second group of columns charged a second time. The operation of the multiplexer circuit is continued in this manner until all groups have been selected, and their associated columns charged, twice. In FIG. 6, showing an example of the video information waveform applied to the video line VI, an indication of the columns to which respective video information is transferred is also shown.

Figure 7:
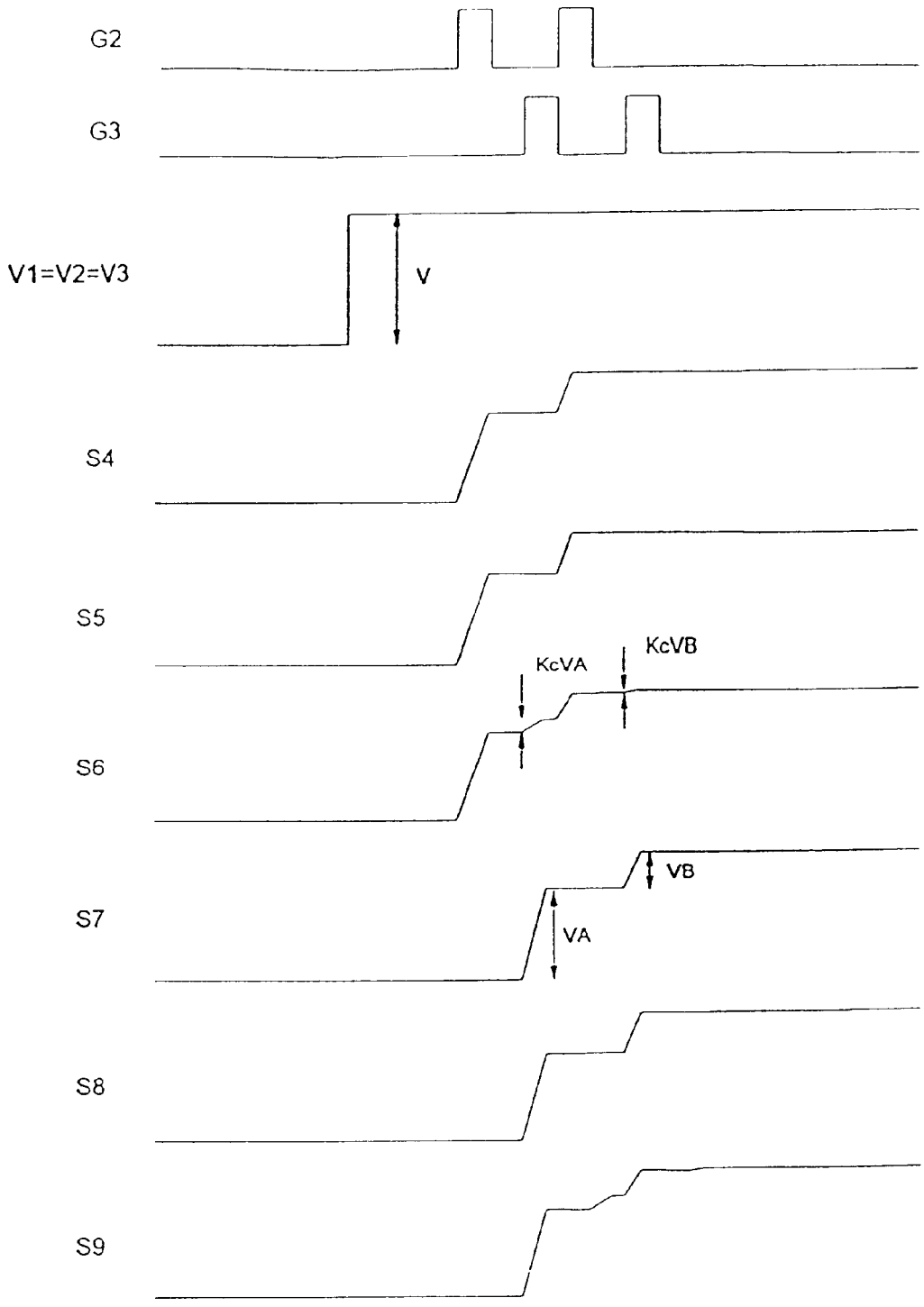

The advantage of adopting this multiple charging approach can be seen by considering the column voltage waveforms shown in FIG. 7. These represent the waveforms that would be present if the display were addressed with a plain, uniform, video field, as described previously, with the same video information being supplied to each of the three video lines V1, V2 and V3, and where the effects of the voltage errors would be most noticeable. Taking, for example, the charging of column S6 then when the multiplexer switch control signal G2 first goes high S6 charges towards the voltage existing on the video line V3. At the end of this charging period G2 goes low and the second group of multiplexer switches turns off. It is to be noted that it is not necessary that the columns have been fully charged to the level of the voltage on video line after this first charging period, i.e. to the required data signal level. During the next charging period the first group of columns, (S1, S2 and S3) is charged for the second time and then immediately after the third group (S7, S8, S9) is charged for the first time. As the voltage on column S7 changes this change is coupled onto column S6 in the manner described previously. At the end of the charging period the voltage on column S7 will have changed by an amount VA and this will have caused the voltage on column S6 to change by an amount KcVA. In the following charging period the video information for the second group of columns is applied to the video lines once more and the second group of multiplexer switches is again selected. The column S6 now charges to the voltage level on video line V3 and the switches turn off. When the third group of columns are charged for the second time the change in the voltage on column S7, VB, will be coupled onto column S6 resulting in a voltage error of just KcVB.

By virtue of the multiple charging method the resulting error in the voltage of column S6 is smaller than that resulting with the conventional, single, charging method by the factor VB/V. The value of the voltage error for example on the column S6 using this multiple charging scheme depends on the change in the column voltage during the second, final, charging period for the column S7. This could be still further reduced by either extending the duration of the charging periods or by increasing the number of charging periods which are used.

Preferably, the columns are charged to a level at least close to their required, final, levels corresponding to the level of the respective data signals during their first charging periods so as to minimise the value of VB.

The voltage errors occurring on the last column of other groups due to the voltage changes appearing on the adjacent, first, column of the succeeding group, and the visibility of artefact caused thereby, are all similarly minimised.

The overall effect is that the size of the voltage error on the last column of the Nth group is proportional to the change in voltage on the first column of the (N+1)th group resulting from the second charging period for the (N+1)th group. Because the change in column voltage on each successive charging will be reduced, the error caused on the last column of the previous group will be smaller. The reduction of this error leads to a reduction in the brightness error in the display elements concerned.

All rows of display elements are addressed in this fashion in consecutive, respective, row address periods.

In an alternative scheme, the column drive circuit may be arranged instead so as to apply the first pulse signals of all the control signals G1, G2, G3 etc in succession so as to operate all the groups of multiplexer switches in succession and then apply all the second pulse signals in succession again rather than interleaving the pulse signals are previously. This approach will similarly reduce voltage errors.

As mentioned, the voltage errors caused by the capacitive coupling effects are most significant for the last column conductor in a group, that is the column conductors immediately adjacent the group next addressed in sequence, and the extent of errors caused to other column conductors in the preceding group progressively decreases the further away the column conductor is from that next addressed group. It may be acceptable in some situations to arrange for the column drive circuit to charge only the last one or two or so column conductors in a group in a plurality of separate charge periods and other column conductors to be charged in a single charge period as normal. In this case, one group could be charged in a respective charge period, the next group charged in a following charge period, and then the last one or two column conductors of the one group then charged again, and so on for all groups.

In a colour display device, colour filter elements are carried on the other substrate in conventional manner and in this case the video input lines V1, V2 and V3 may each carry a respective colour, red, green and blue, video information component with adjacent columns in the array being arranged to display red, green and blue information.

While the invention has been described in relation to a kind of display device structure in which the display element electrodes are carried above the active matrix circuitry on an insulating layer in particular, it is applicable to other types of display structures in which the electrodes 18 are situated at a similar level to, and laterally of, the TFTs and sets of addressed conductors, for example of the kind described in U.S. Pat. No. 5,130,829.

The part of the column drive circuit 35 which supplies the video signal to the video input lines (e.g. V1, V2 and V3) and the control circuit 37 which applies the control signals, G1, G2, G3, etc to the multiplexer switches need not be integrated on the substrate 25 but instead may be formed separately and connected to the multiplexing circuit on the substrate.

Moreover, whilst it is particularly convenient for at least the multiplexing circuit of the column drive circuit to be fully integrated on the same substrate as the active matrix circuitry, this part of the drive circuit, and likewise the row drive circuit, could be fabricated as a separate component and electrically interconnected with the active matrix circuitry, for example using chip-on-glass technology.

From reading the present disclosure, other modifications will be apparent to persons skilled in the art. Such modifications may involve other features which are already known in the field of active matrix liquid crystal display devices and component parts thereof and which may be used instead of or in addition to features already described herein.

What is claimed is:

1. An active matrix liquid crystal display device comprising a row and column array of liquid crystal display elements, each display element having an associated switching device, sets of row and column address conductors connected to the display elements via which selection signals and data signals respectively are applied to the display elements, a row drive circuit for applying selection signals to the row address conductors in respective row address periods and a column drive circuit for applying data signals to the set of column address conductors which column drive circuit is operable to apply the data signals for the display elements of a row to groups of column address conductors in sequence in respective group address periods, each group comprising a plurality of column address conductors with the column address conductors in a group being charged in the respective group address period according to the level of their relevant data signals, characterised in that the column drive circuit is arranged to charge during a row address period at least the last column conductor of a group in at least two separate charging periods with the second charging period for the at least last column conductor occurring after a charging period of the next group in the sequence.

2. An active matrix liquid crystal display device according to claim 1, characterised in that the column drive circuit is arranged to charge each column conductor in at least two separate charging periods with the second charging period for one group occurring after the first charging period of the next group in the sequence.

3. An active matrix liquid crystal display device according to claim 2, characterised in that the charging periods for two successive groups are interleaved in time.

4. An active matrix liquid crystal display device according to claim 2, characterised in that the first charging periods for all the groups occur in a first portion of the row address period and the second charging periods for all the groups occur in a subsequent portion of the row address period.

5. An active matrix liquid crystal display device according to claims 2, 3 or 4, characterised in that the first and second charging periods are of substantially similar duration.

6. An active matrix liquid crystal display device according to claim 1, characterised in that in the first charging period the column address conductors concerned are charged at least close to the required final level.

* * * * *